US008381936B1

(12) United States Patent
Blake

(10) Patent No.: US 8,381,936 B1
(45) Date of Patent: Feb. 26, 2013

(54) LAUNDRY-SORTING HAMPER DEVICE

(76) Inventor: Kenneth S. Blake, Ozone Park, NY (US)

( * ) Notice: Subject to any disclaimer, the term of this patent is extended or adjusted under 35 U.S.C. 154(b) by 0 days.

(21) Appl. No.: 13/277,655

(22) Filed: Oct. 20, 2011

Related U.S. Application Data

(60) Provisional application No. 61/407,753, filed on Oct. 28, 2010.

(51) Int. Cl.
*B65D 1/24* (2006.01)

(52) U.S. Cl. ..... 220/500; 220/524; 220/527; D32/37

(58) Field of Classification Search ..... 220/523, 220/524, 527, 553, 500, 503, 506, 507, 505; D32/37; 132/286; 15/264
See application file for complete search history.

(56) References Cited

U.S. PATENT DOCUMENTS

| | | | | | |
|---|---|---|---|---|---|
| 2,625,973 | A | | 1/1953 | Weldon et al. | |
| 5,118,173 | A | * | 6/1992 | Proctor et al. | 312/213 |
| 5,154,359 | A | | 10/1992 | Junta et al. | |
| 5,484,078 | A | | 1/1996 | Bronovicki | |
| D392,782 | S | * | 3/1998 | McLain | D32/37 |
| 5,833,336 | A | * | 11/1998 | Dean | 312/293.2 |
| 5,873,643 | A | | 2/1999 | Burgess, Jr. et al. | |
| 6,062,416 | A | * | 5/2000 | Smillie | 220/524 |
| D460,590 | S | * | 7/2002 | Hodge et al. | D34/1 |
| D462,149 | S | * | 8/2002 | Hall | D32/37 |
| 6,691,879 | B1 | * | 2/2004 | Alvarez | 211/175 |
| 6,761,367 | B2 | * | 7/2004 | Fite | 280/47.26 |
| 7,552,825 | B2 | * | 6/2009 | Caporrino | 206/576 |
| 2001/0027977 | A1 | * | 10/2001 | Hall | 220/523 |
| 2006/0157358 | A1 | * | 7/2006 | Heidel | 206/278 |

* cited by examiner

*Primary Examiner* — Mickey Yu
*Assistant Examiner* — Kareen Rush

(57) ABSTRACT

A laundry-sorting hamper device including a top portion disposed atop a bottom portion, the top portion including a plurality of horizontally-aligned top-loading box compartments, each of said plurality of compartments including an open top, an access door hingedly disposed upon a front side proximal to a closed bottom side, and a color-code bar disposed on the front side, wherein laundry is presorted between the plurality of compartments, and easily retrievable therefrom into a plurality of baskets, each of the plurality of baskets storable in the bottom portion, each basket underlying each compartment. The present laundry-sorting hamper device further includes an alternative embodiment for use in tight spaces, wherein the plurality of compartments are stacked atop each other, each of the plurality of compartments having an accepting window disposed in the front side through which laundry is inserted into each compartment.

6 Claims, 4 Drawing Sheets

LAUNDRY-SORTING HAMPER DEVICE

BACKGROUND OF THE INVENTION

Various types of laundry hampers are known in the prior art. However, what is needed is laundry-sorting hamper that provides a plurality of compartments each of which has a color-code bar disposed thereon to separate laundry by color for washing. The compartments are horizontally aligned atop a bottom portion having a basket which fits underneath each compartment or, alternately, stacked atop each other. Vertically aligned vent holes, which are centrally disposed, on a front side of each compartment provide visual notification of the fill level of the compartments and also serve to prevent molding laundry.

FIELD OF THE INVENTION

The present invention relates to laundry hamper, and more particularly, to a laundry-sorting hamper device.

SUMMARY OF THE INVENTION

The general purpose of the present laundry-sorting hamper device, described subsequently in greater detail, is to provide a laundry-sorting hamper device which has many novel features that result in a laundry-sorting hamper device which is not anticipated, rendered obvious, suggested, or even implied by prior art, either alone or in combination thereof.

To accomplish this, the present laundry-sorting hamper device includes a top portion including a plurality of horizontally-aligned top-loading box compartments and a bottom portion including a basket disposed underneath each compartment. Each compartment has an open top side, an open bottom side, a front side, a rear side, a first side, and a second side. An access door is disposed on the front side proximal to a bottom side of the compartment. A handle is disposed on a forward side of each access door. A sliding latch closure mechanism is disposed on the forward side near a top end of each access door. A color-code bar is disposed on a front side proximal to an open top side of each compartment to notify a user of the color of laundry which is to be inserted into each compartment. A plurality of vertically aligned holes are centrally disposed in the front side between the access door and the color-code bar. The holes provide a visual notification of the laundry fill level to notify a user as to when the basket and compartment are full and also prevents molding of the dirty laundry. To remove the dirty laundry from one of the compartments for washing, a user opens the access door and removes the pre-sorted laundry.

An alternative embodiment provides a stackable version of the device for storage in limited space, such as in a closet. The stackable design includes a plurality of compartments, having closed top sides and closed bottom sides, stacked atop each other and an accepting window, for inserting clothes therethrough into the compartment, disposed on the front side of each compartment proximal to the top side above the color-code bar. Also, the stackable version includes at least one hole disposed on the front side above the access door.

The instant laundry-sorting hamper device saves time and effort by eliminating the need to sort clothing prior to doing a load of laundry. The organizational design of the present device replaces a traditional hamper. The present device further eliminates the need to place dirty laundry in one large pile or into a hamper until the laundry is ready for washing. In use, the color of laundry to be stored in each compartment is displayed within the color-code bar. The user ensures that a laundry basket is disposed beneath each compartment. To fill the basket, a user places a dirty laundry item into the top side of one of the compartments having a corresponding color displayed on the color-code bar. A user retrieves dirty laundry from the compartments one at a time to keep the dirty laundry separated by color for washing.

Thus has been broadly outlined the more important features of the present laundry-sorting hamper device so that the detailed description thereof that follows may be better understood and in order that the present contribution to the art may be better appreciated.

Numerous objects, features and advantages of the present laundry-sorting hamper device will be readily apparent to those of ordinary skill in the art upon reading the following detailed description of presently preferred, but nonetheless illustrative, examples of the present laundry-sorting hamper device when taken in conjunction with the accompanying drawings.

BRIEF DESCRIPTION OF THE DRAWINGS

Figures

DETAILED DESCRIPTION OF THE DRAWINGS

Figure 1:
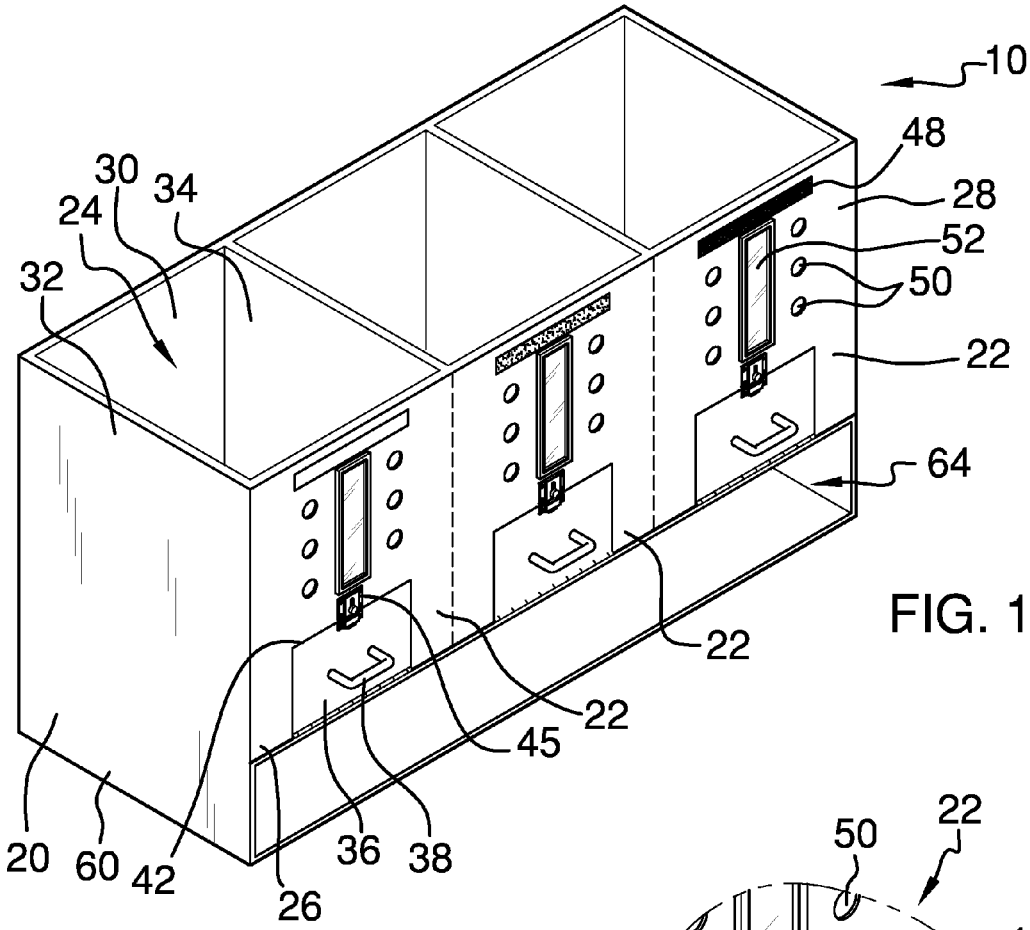
FIG. 1 is an isometric view.
Figure 2:
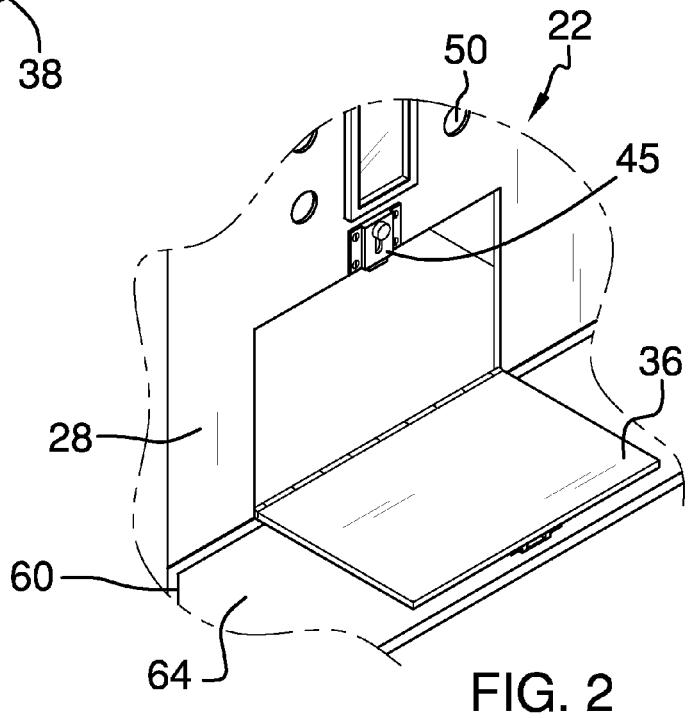
FIG. 2 is a detail view of an access door.
Figure 3:
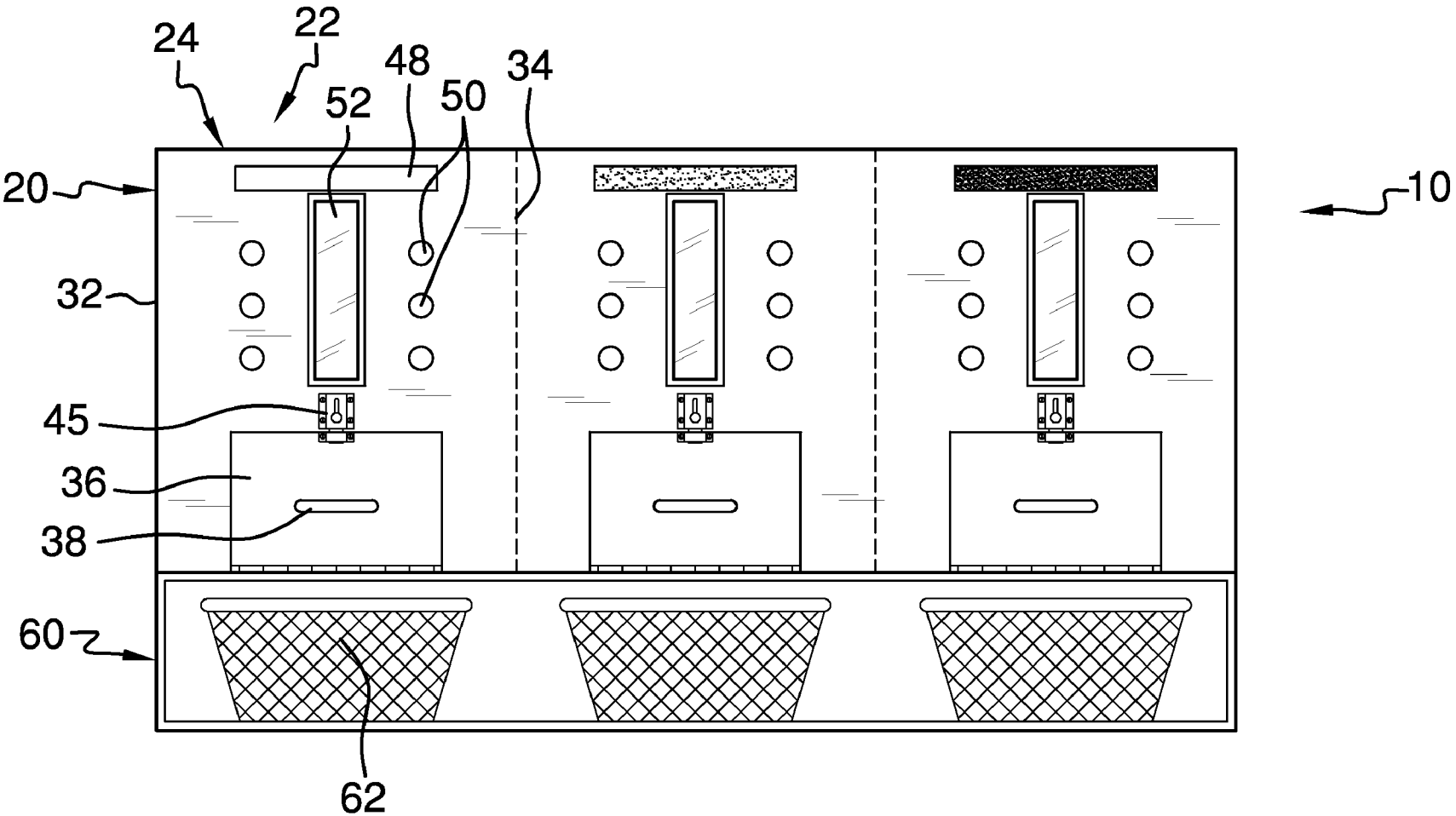
FIG. 3 is a front view.
Figure 5:
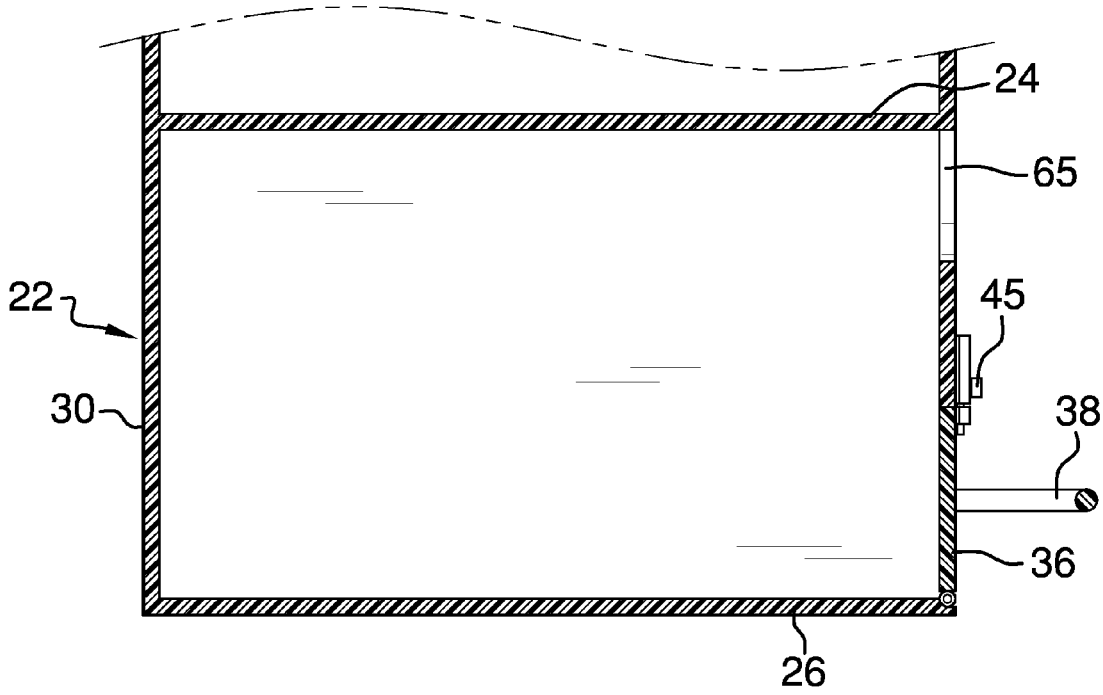
FIG. 5 is a cross-section view taken along the line 5-5 of FIG. 4.

With reference now to the drawings, and in particular FIGS. 1 and 5 thereof, example of the instant laundry-sorting hamper device employing the principles and concepts of the present laundry-sorting hamper device and generally designated by the reference number 10 will be described.

The present laundry-sorting hamper device 10 includes a top portion 20 and a hollow parallelepiped bottom portion 60. The top portion 20 includes a plurality of horizontally-aligned top-loading box compartments 22. The bottom portion 60 includes a basket 62 disposed underneath each compartment 22 and an open front 64. Each compartment 22 has an open top side 24, a closed bottom side 26, a front side 28, a rear side 30, a first side 32, and a second side 34. An access door 36 is disposed on the front side 28 proximal to a bottom side 26 of each compartment 22. A handle 38 is disposed on a forward side 40 of each access door 36. A sliding latch closure mechanism 45 is disposed on the forward side 40 proximal to a top end 42 of each access door 36. A color-code bar 48 is disposed on a front side 28 proximal to the top side 24 of each compartment 22 to notify a user of the color of laundry which is to be inserted into each compartment 22. A vertically aligned plurality of ventilator holes 50 is disposed in the front side 28 between the access door 36 and the color-code bar 48. The plurality of ventilator holes 50 permit air to flow through the compartments 22 to reduce the potential for mold.

A rectangular fill indicator 52 is centrally disposed in the front side 28. The fill indicator 52 is a transparent window inset into the front side 28 to provide a visual notification of the laundry fill level and to notify a user when the compartment 22 is full. The compartments 22 are aligned adjacent to each other atop the bottom portion 60. To remove the dirty laundry from one of the compartments 22 for washing, a user opens the access door 36 and removes the pre-sorted laundry and places the laundry into the underlying basket 62.

Figure 4:
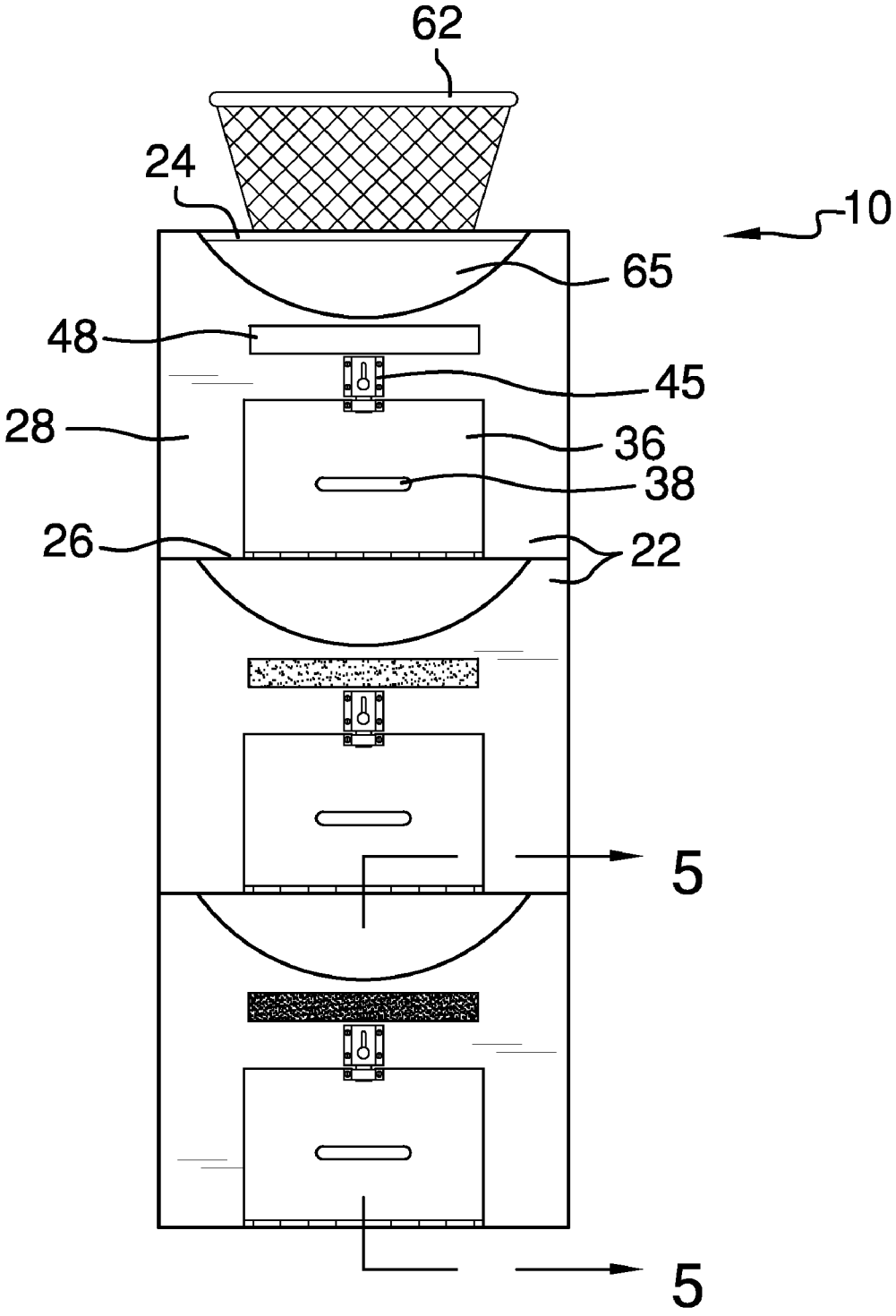
FIG. 4 is a front view of an alternative embodiment.

An alternative embodiment provides a stackable version of the device 10 for storage in limited space, such as in a closet (see FIG. 4). The stackable design includes a plurality of compartments 22 each of which has a closed top side 24 and a closed bottom side 26. The compartments 22 are stacked atop each other and an accepting window 65 is disposed on the front side 28 of each compartment 22 proximal to the top side above the color-code bar 48. The accepting window 65 permits a user to place clothes therethrough into the compartment 22. In the stackable version, at least one hole 50 is also disposed on the front side 28 to permit air flow through the compartments 22 which reduces the potential for mold. In this version, the basket 62 is not disposed underneath each compartment 22, but instead is placed atop the stack of compartments 22. Dirty laundry is retrieved from the compartments 22 one at a time and placed into the basket 62 to keep the dirty laundry separated by color for washing.

What is claimed is:

1. A laundry-sorting hamper device comprising:

a top portion comprising:

a plurality of horizontally-aligned top-loading box compartments, each of the box compartments comprising:

an open top side;

a closed bottom side;

a front side;

a rear side;

a first side;

a second side;

an access door hingedly disposed on the front side, the access door proximal to the bottom side, the access door having a forward side and a top end;

a handle disposed on the access door forward side;

a sliding latch closure mechanism disposed on the front side proximal to the access door top end, the sliding latch closure mechanism releasably engaging the access door;

a color code bar disposed on the front side proximal to the top side;

a plurality of vertically aligned ventilation holes disposed in the front side;

a rectangular fill indicator centrally disposed in the front side;

a parallelepiped bottom portion disposed underlying the top portion, the bottom portion having an open front;

wherein laundry is presorted when added to each of the plurality of compartments, said laundry retrievable from each compartment by means of the access door disposed in the front side of each compartment.

2. The laundry-sorting hamper device of claim 1 wherein the fill indicator comprises a rectangular transparent window vertically aligned in the front side.

3. The laundry-sorting hamper device of claim 2 wherein a plurality of baskets is fittable within the bottom portion, each of the plurality of baskets positionable underlying each of the plurality of compartments.

4. The laundry-sorting hamper device of claim 1 wherein each of the compartments is stacked atop each other.

5. The laundry-sorting hamper device of claim 4 wherein each of the plurality of compartments further comprises:

a closed top side;

an accepting window disposed on the front side proximal to the top side;

wherein laundry is inserted into each of the plurality of compartments through each accepting window.

6. The laundry-sorting hamper device of claim 5 wherein a basket is positional atop the plurality of compartments.

* * * * *